United States Patent [19]

Notelteirs et al.

[11] 4,396,858

[45] Aug. 2, 1983

[54] HALOGEN INCANDESCENT LAMP

[75] Inventors: Victor R. Notelteirs; Gustaaf F. R. Siaens, both of Eindhoven, Netherlands

[73] Assignee: U.S. Philips Corporation, New York, N.Y.

[21] Appl. No.: 357,964

[22] Filed: Mar. 15, 1982

Related U.S. Application Data

[63] Continuation of Ser. No. 132,944, Mar. 24, 1980, abandoned.

[30] Foreign Application Priority Data

Apr. 4, 1979 [NL] Netherlands ..... 7902840

[51] Int. Cl.[3] ..... H01K 1/28

[52] U.S. Cl. ..... 313/579

[58] Field of Search ..... 313/222, 178, 179

[56] References Cited

U.S. PATENT DOCUMENTS

| | | | |
|---|---|---|---|
| 3,719,853 | 3/1973 | Sugane et al. | 313/222 |
| 3,849,687 | 11/1974 | Huston et al. | 313/222 |
| 3,956,660 | 5/1976 | Ooms | 313/222 |

*Primary Examiner*—Bruce C. Anderson

*Attorney, Agent, or Firm*—Robert S. Smith

[57] ABSTRACT

A two-pinch line voltage halogen incandescent lamps according to the invention has metal foils in the pinches which foils are connected to respective internal current conductors and external conductors. The metal foils extend from the pinches into the cavity formed by the lamp envelope. The internal current conductors have a maximum diameter of 300 μm and are welded to the metal foils in a place situated in the cavity formed by the lamp envelope, in a place situated in the pinch, or both in the cavity and in the pinch. The construction prevents explosion of the lamp as a result of cracking of the pinches caused by a discharge arc.

3 Claims, 5 Drawing Figures

HALOGEN INCANDESCENT LAMP

Figure 1:
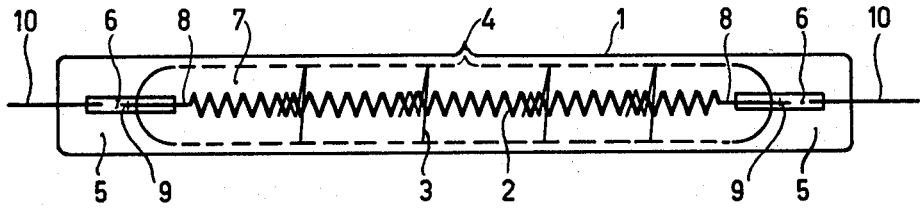

This is a continuation of application Ser. No. 132,944, filed Mar. 24, 1980 abandoned.

The invention relates to a line voltage halogen incandescent lamp having a tubular quartz glass envelope which is filled with an inert gas containing hydrogen bromide and in which a tungsten filament is arranged axially. The envelope is sealed at each end in a vacuum-tight manner by means of a respective pinch around a metal foil. A respective external current conductor and a respective internal current conductor extending from the pinch towards the filament are welded to each of the foils.

Such a lamp is disclosed in British Pat. No. 1,094,694 in which the metal foils are situated entirely in a pinch.

It has been found that such line voltage lamps can explode, at the end of their lives, even when an external fuse is used, due to crack in a pinch.

It is the object of the invention to provide a simple lamp construction which obviates the danger of explosion by cracking of a pinch in line voltage lamps, that is to say in lamps having a nominal voltage between 110 and 250 V, as a result of the formation of a discharge arc in the pinch.

In lamps of the kind mentioned in the opening paragraph this object is achieved in that the metal foils each extend from the relevant pinch into the cavity formed by the lamp envelope and that the internal current conductors have a diameter of at most 300 μm.

The invention is based on the following recognition. As a result of the large difference in coefficients of thermal expansion between quartz glass, by which are denoted glasses having an $SiO_2$ content of at least 95% by weight, and tungsten or molybdenum, a capillary space is present in known lamps around the internal current conductor, extending into the pinches up to the metal foils. This means both that there is hardly any contact between the internal current conductors and the glass of the pinches, and also that the glass filling of the lamp is in contact with the internal current conductor in the pinches.

In lamps having a comparatively long computed life, the end of life can be reached in that so much metal is removed by the halogen from one of the comparatively cold internal current conductors from a place situated inside or just outside a pinch, that the internal current conductor fuses. A discharge arc is then formed within the pinch or a discharge arc is formed just outside the pinch and penetrates into the pinch. This results in a very rapid evaporation of metal in the pinch. The resulting very high presssure in the pinch causes the pinch to crack and the lamp to explode.

In lamps having a comparatively short computed life in the filament fuses after it has become thin in a hot place as a result of evaporation. The resulting discharge arc penetrates into a pinch which is then cracked.

Due to structural measures taken in the lamps according to the invention wherein the metal foils each extend from the pinches into the cavity formed by the lamp envelope, there is a current conductor, (the foil) from the interior of the pinch into the cavity of the lamp envelope which is in intimate contact with the glass of the pinch. Consequently there is also a good heat transfer from the foil to the glass of the pinch. Thermal energy evolved in the internal current conductor is easily dissipated to the glass due to its contact with the foil throughout its length situated inside the pinch. This makes it impossible for a discharge arc to form or propagate in the pinch.

It is of importance for the internal current conductor to be not too thick. According as the internal current conductor has a diameter larger than 300 μm, the possibility becomes larger that a discharge arc formed in the cavity of the lamp envelope is maintained without causing the internal current conductor to fuse. The high arc current can then produce so much heat in the pinch that explosion of the lamp occurs.

The lamps according to the invention may be realized in various forms.

In a first embodiment the weld between an internal current conductor and the relevant metal foil is present in the pinch. The internal current conductor, in so far as it is present in the pinch, engages the metal foil. If, due to the incomplete engagement of the glass of the pinch, attack of the internal current conductor by the halogen should occur in a place situated in the pinch and giving rise to fracture, the metal foil is still there as a parallel current conductor. If the electric contact in the pinch should be lost entirely, the close contact between the glass of the pinch and the metal foil and between the internal current conductor and the metal foil ensures that no arc is formed.

An arc which might be formed in the cavity of the lamp envelope will extinguish as soon as it has approached the pinch.

In a second embodiment an internal current conductor is welded to the relative metal foil both in a position situated in the pinch and in a position situated within the cavity formed by the lamp envelope. The advantage of this embodiment is that attack of the internal current conductor between the pinch and the welded spot which is situated in the cavity does not lead to extinction of the lamp since the metal foil forms a parallel conductor over this track.

In a further embodiment, an internal current conductor is welded to the metal foil only in a place situated within the cavity formed by the lamp envelope.

An internal current conductor may consist of a limb of the filament, that is to say that conductor and filament are formed from one piece of wire. However, an internal current conductor may alternatively be a separate component which is secured to the filament, for example, by screwing it therein or therearound.

Lamps according to the invention of high power, for example 500 W and more, have proved particularly suitable for use as photolamps, studio lamps, copying lamps and the like.

It is to be noted that a mono-pinch iodine lamp for use in optical systems is disclosed in U.S. Pat. No. 3,543,078, which lamp has a compact filament and is therefore destined for operation at low voltage. In this known lamp the metal foils also extend into the lamp envelope. However, the object thereof is both to control vibrations of the filament and to prevent the limbs of the filament from emitting light. Explosion safety is not aimed at by the construction of this known lamp. On the one hand, in lamps which are operated at low voltage, danger of explosion does not occur and on the other hand the construction shown in FIG. 2 prevents an intimate contact between the foils and the glass of the pinch.

Embodiment of lamps according to the invention are shown in the drawing. In the drawing FIG. 1 is an elevation of a line voltage halogen incandescent lamp, FIG. 2 and FIG. 3 each show a detail of modified embodiments of the lamp shown in FIG. 1; and FIG. 4 and FIG. 5 each show a detail of other modified embodiments of lamps in accordance with the invention.

In FIG. 1 a tungsten filament 2 centered by supports 3 is arranged axially in a tubular lamp envelope 1. The lamp envelope is sealed by means of an exhaust tube seal 4 and a respective pinch 5 at each end. A tungsten or molybdenum foil 6 is incorporated in each of the pinches 5. In order to ensure a good seal around said foils, the foils are etched on their longitudinal sides. The foils extend from the respective pinch 5 into the cavity 7 bounded by the lamp envelope 1. The limbs 8 of filament 2 are each welded to a respective foil 6 at point 9. A respective external current conductor 10 is also connected to each of the foils 6. The lamp shown is a 220 V 1000 W photo lamp having a filament of wire having a diameter of 180 μm, yielding during operation a colour temperature of 3400° K. The lamp comprises 1 bar of $Ar/N_2$ 92/8 vol/vol to which 2.4% by volume of HBr has been added. The metal foils consist of molybdenum and have a largest thickness of 30 μm.

In FIGS. 2 to 5 the same reference numerals are used for corresponding components.

Figure 2:
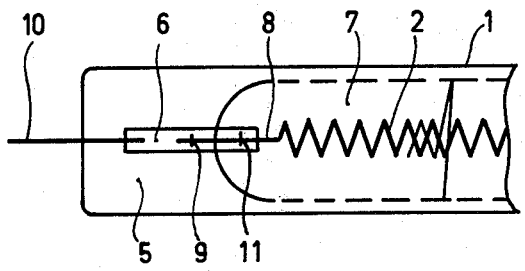

In FIG. 2 the limb 8 of the filament is welded to the foil 6 both at 9 and at 11.

Figure 3:
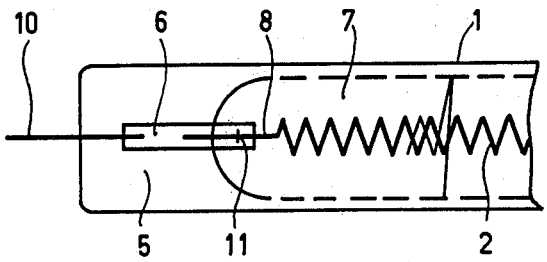

In FIG. 3 the limb 8 is connected to the foil 6 by a weld only at 11 inside the cavity bounded by the lamp envelope 1. However, the limb 8 extends into the pinch 5.

In FIGS. 1 to 3 the limbs 8 of the filament 2 constitute the internal current conductors.

Figure 4:
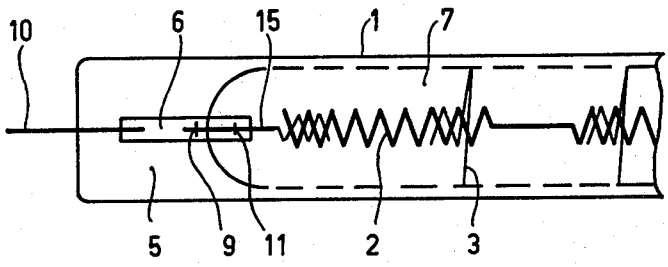

In FIG. 4 the internal current conductor 15 is a wire (diameter 250 μm) which is wound helically at one end and which is screwed into the filament 2.

Figure 5:
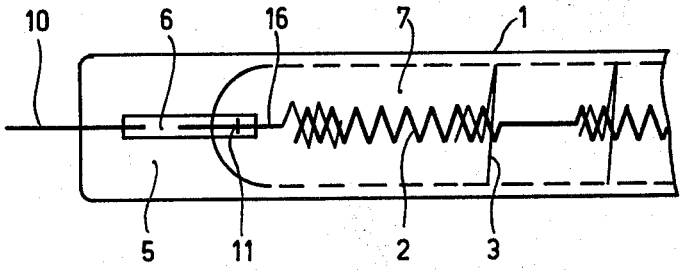

In FIG. 5 the internal current conductor 16 is a wire (diameter 300 μm) which is wound helically at one end and which is screwed around the filament 2. FIGS. 4 and 5 each show a part of a copying lamp of 220 V 1000 W.

Experiments have proved that these lamps are safeguarded effectively against explosions.

What is claimed is:

1. A line voltage halogen incandescent lamp having a tubular quartz glass lamp envelope which is filled with an inert gas containing hydrogen bromide, a tungsten filament axially disposed in said envelope, and further including two metal foils, said lamp envelope being sealed at each end in a vacuum-tight mannery by means of a respective pinch around a respective one of said metal foils to define a cavity within said envelope, a respective external current conductor welded to the outer end of a respective one of said metal foils extending from each pinch and a respective internal current conductor welded to a respective one of said metal foils extending from within a respective pinch towards the filament, wherein said metal foils each extend from within the relevant pinch into said cavity and the internal current conductors have a diameter of at most 300 micrometers.

2. A halogen incandescent lamp as claimed in claim 1, wherein each metal foil is welded to a respective one of said internal current conductors in a place situated within the said cavity.

3. A halogen incandescent lamp as claimed in claim 1, wherein each metal foil is welded to a respective one of said internal current conductors in a place situated within said cavity and also in a place situated within the relevant pinch.

* * * * *